United States Patent [19]

Kiyosawa

[11] Patent Number: 4,878,301

[45] Date of Patent: Nov. 7, 1989

[54] SPORTS SHOE

[75] Inventor: Junichi Kiyosawa, Kobe, Japan

[73] Assignee: Asics Corporation, Kobe, Japan

[21] Appl. No.: 211,053

[22] Filed: Jun. 24, 1988

[30] Foreign Application Priority Data

Jun. 25, 1987 [JP] Japan ..... 62-98011

[51] Int. Cl.[4] ..... A43B 23/08

[52] U.S. Cl. ..... 36/69; 36/35 R; 36/37

[58] Field of Search ..... 36/34 A, 35 R, 35 B, 36/37, 68, 69, 92, 129

[56] References Cited

U.S. PATENT DOCUMENTS

| | | | |
|---|---|---|---|
| Re. 27,512 | 10/1972 | Onitsuka . | |
| 185,996 | 1/1877 | Williams | 36/69 |
| 2,586,045 | 2/1952 | Hoza . | |
| 2,738,600 | 3/1956 | Shultz . | |
| 3,169,326 | 2/1965 | Butera . | |
| 3,416,174 | 12/1968 | Novitske . | |
| 3,535,799 | 10/1970 | Onitsuka . | |
| 4,255,877 | 3/1981 | Bowerman . | |
| 4,287,675 | 9/1981 | Norton et al. . | |
| 4,288,929 | 9/1981 | Norton et al. . | |
| 4,402,146 | 9/1983 | Parracho et al. . | |
| 4,484,397 | 11/1984 | Curley, Jr. . | |
| 4,506,460 | 3/1985 | Rudy . | |
| 4,580,359 | 4/1986 | Kurrash et al. . | |
| 4,622,764 | 11/1986 | Boulier | 36/69 |
| 4,625,435 | 12/1986 | Ueda . | |
| 4,704,809 | 11/1987 | Ballard . | |
| 4,766,679 | 8/1988 | Bender . | |

FOREIGN PATENT DOCUMENTS

| | | | |
|---|---|---|---|
| 115427 | 8/1984 | European Pat. Off. | 36/69 |
| 7533703 | 11/1975 | France | 36/69 |
| 57-74708 | of 1982 | Japan . | |
| 60-24162 | of 1985 | Japan . | |

*Primary Examiner*—Werner H. Schroeder
*Assistant Examiner*—D. Biefeld
*Attorney, Agent, or Firm*—Nixon & Vanderhye

[57] ABSTRACT

A sports shoe is disclosed which is provided with a heel counter comprising a heel side wall part shaped with a curve along an under heel part of shoe, and a lower surface part formed integrally with the inner wall surface of the heel side wall part as projected inside the curve, the lower surface part being provided with a plurality of recesses or through holes defined with a plurality of wall members protruding in a direction intersecting the surface of the lower surface part, the heel counter being formed of a hard elastic material, and the heel counter being nipped between the upper of shoe and the sole of shoe.

9 Claims, 5 Drawing Sheets

SPORTS SHOE

This invention relates to a sports shoe.

In the shorts shoe, a heel of the shoe is required to possess a rich elasticity to date. This heel is required also to possess rigidity capable of preventing the heel itself from generating lateral sway.

The heel needs the rich elasticity for the following purpose. When a runner's foot in a shoe stamps on the ground, the shock of landing is transmitted to the knee joint, the ligament, etc. of his leg. If the runner happens to jog in sports shoe with degraded elasticity, therefore, the knee joints, the ligaments, etc. of his legs are liable to accumulate stress. If this stress is left building up, it has the possibility of inflicting various lesions upon his legs possibly to the extent of jeopardizing his faculty of running. Particularly, the shock of landing mentioned above has its influence most heavily in the portion of his heel that lands on the ground first. In the sports shoe worn by the runner, it is normally in the heel that the shoe first lands on the ground. Thus, the heel is destined to expose itself to the largest force of the shock of landing.

For the purpose of imparting to the heel an ability to alleviate the shock of landing and exhibit rich elasticity, it has been customary to use in a sports shoe a midsole which is produced by superposing elastic materials of varying hardness. Since the midsole of this description relies for alleviation of the shock solely upon the elastic characteristic of the elastic materials, this midsole, particularly the heel portion thereof, is liable to give in on exposure to repeated exertion of the largest force of the shock of landing which reaches a level two to three times the runner's body weight. Thus, the midsole has a disadvantage that it quickly loses the rich elasticity.

The heel of the sports shoe needs the rigidity enough to prevent the heel itself from generating lateral sway for the following reason. An ordinary runner, in the process of kicking the ground with his foot in a sports shoe during the course of a jogging, for example, is disposed to tilt the ankle either inwardly or outwardly. If the rigidity of the heel part in the sports shoe is not sufficient, there is a very strong possibility that the heel part of the shoe will be deformed and, as the result, the inward or outward tilt or inclination of the runner's ankle will occur to excess. This excess inclination can be a cause for lesions in various joints such as the ankle and the knee. In an extreme case, it can inflict a sprain upon the runner's anklebone.

For obtaining the rigidity which prevents the aforementioned lateral sway, some of the conventional sports shoes have incorporated in the uppers or inside the shoe sole a heel cup, namely a crescent core member formed of hard leather or hard plastic material. The heel cup of this sort is generally formed separately of the uppers or the shoe sole and is attached by adhesion or sewing to the upper or the shoe sole. When the sports shoe using this heel cup is exposed to an unduly large landing pressure exerted in a direction intersecting the direction of stamping and, that is, when the inward or outward inclination of the ankle occurs to excess, the adhesion or the seam keeping the attached heel cup in place is disrupted so much as to induce separation of the heel cup from the upper or the shoe sole. The heel cup, therefore, has a disadvantage that it is incapable of acquiring high rigidity enough to preclude the occurrence of lateral sway of the heel part.

This invention has been accomplished in view of the true state of affairs mentioned above. An object of this invention is to provide a highly durable sports shoe provided with a heel part which abounds with high elasticity enough to alleviate the shock of landing and exhibits high rigidity enough to eliminate the lateral sway at the time of landing.

To accomplish the foregoing objects and in accordance with the present invention, there is provided a sports shoe comprising an upper portion, a sole portion fitted to the upper portion, and a heel counter fixed to the upper portion and the sole portion, respectively, the heel counter including a lower part nipped between the upper portion and the sole portion, and having a plurality of wall members extending generally vertically and between upper and lower surfaces of the lower part to define a plurality of spaces. The spaces open through at least one of the upper and lower surfaces toward the upper portion or the sole portion, respectively, each of the wall members having a wall thickness less than the lateral dimension of the spaces between the wall members and a heel side wall port formed integrally with the lower part. The heel side wall part extends along the periphery of the lower part and upwardly from the lower part.

This invention can be provided a highly durable sports shoe whose heel part is enabled by the heel counter to acquire high rigidity enough to alleviate the shock of landing and eliminate the lateral sway at the time of landing.

Now, typical sports shoe as preferred embodiments of this invention will be described below with reference to the accompanying drawings.

Figure 1:
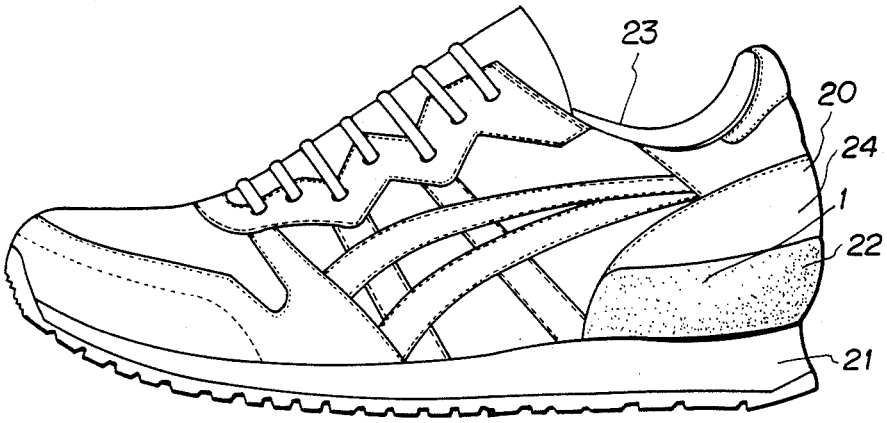
FIG. 1 is a side view of a sports shoe according to this invention.

As illustrated in FIG. 1, a sports shoe 23 according to the present invention is provided with an upper 20, a shoe sole 21, and a heel counter 22 nipped between the upper 20 and the shoe sole 21.

Figure 2:
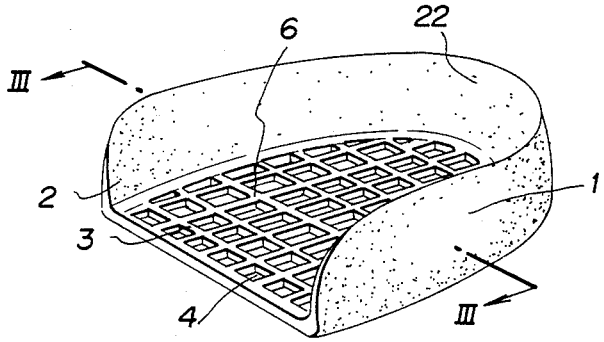
FIG. 2 is a perspective view of a heel counter incorporated in the sports shoe according to this invention.
Figure 3:
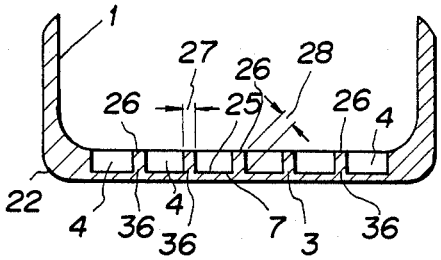
FIG. 3 is a cross section view taken through FIG. 2 along the line III—III, illustrating a typical heel counter of a sports shoe as the first embodiment of the present invention.
Figure 4:
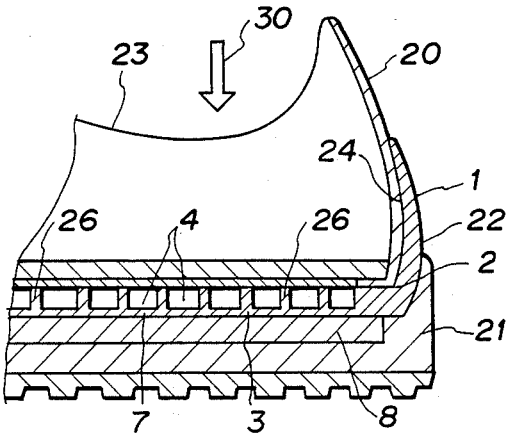
FIG. 4 and FIG. 5 are explanatory diagrams for explanation of changes caused by load in the heel counter of the sports shoe according to the present invention.
Figure 5:
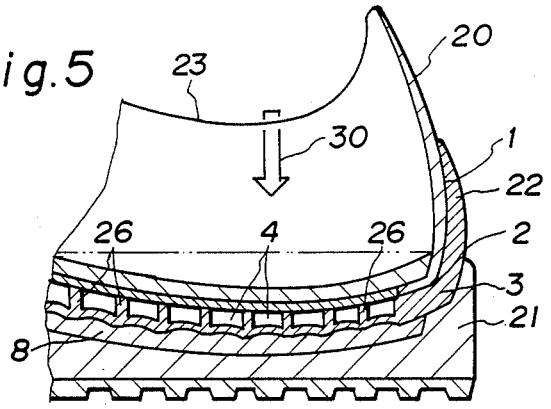
Figure 7:
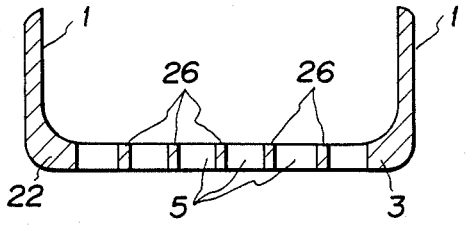
FIG. 7 is a cross section view taken through FIG. 2 along the line III—III, illustrating a typical heel counter of a sports shoe as the third embodiment of this invention.

The heel counter 22 is made preferably of a hard elastic material. The heel counter 22 comprises, as illustrated in FIG. 2 and FIG. 3, heel side wall parts 1 shaped with a curve formed along an under heel part 24 of the sports shoe 23 and a lower surface part 3 extended integrally from a wall surface 2 on the inner side of the heel side wall part 1 toward the inner side of the curved portion of the heel side wall part 1. The lower surface part 3 is provided with a bottom surface part 7 and wall members 26 projected from one surface 25 of the bottom surface part 7 integrally upwardly in FIG. 3. A plurality of recesses 4 are formed with the bottom surface part 7 and the wall members 26 jointly. The heel counter 22 is required to possess high elasticity enough to serve as a highly desirable cushion as fitted in the sports shoe 23 and an ample shape-retaining property enough to enclose the heel of the user of the sports shoe 23 and prevent the lateral sway, i.e. a sway in the direction intersecting the stamping direction of the wearer's foot. Thus, the hard elastic material used for the heel counter 22 possesses rigidity in the range of 60 to 90 degrees. As examples of the hard elastic material usable herein, elastomers such as natural rubber, styrene-butadiene rubber, butadiene rubber, isoprene rubber, acrylonitrile-butadiene rubber, polyurethane, and high-styrene resin. One member or a mixture of two or more members selected from the group of elastomers enumerated above can be used. Glass fibers, carbon graphite, etc. are also available. The each wall member 26 is shaped so as to measure 1 to 3 mm in width 27 and 2 to 4 mm in height 28 as illustrated in FIG. 3. When the wall members 26 receive the pressure exerted thereon in the aforementioned stamping direction, portions 36 of a narrow width press a shoe bottom part 21 supporting the lower surface part 3 through the bottom surface part 7. As the result, the wall members 26 are enabled to depress the shoe bottom part 21 readily in the stamping direction. In other words, the lower surface part 3 provided with the wall members 26 is thus adapted to be readily sunken down as a whole in the stamping direction. The wall members 26 are narrow strips arranged in the pattern of a lattice as illustrated in FIG. 2, FIG. 3, and FIG. 7. When they receive the pressure exerted thereon in the stamping direction as illustrated in FIG. 4 and FIG. 5, therefore, the load applied per unit area to the portions of the width 27 increases. As the result, the bottom surface part 7 deforms as illustrated in FIG. 5 and depresses a layer 8 of the shoe bottom part 21 and enables the lower surface part 3 as a whole to sink down in the direction of an arrow 30. In other words, the pressure exerted in the stamping direction while the user of the sports shoe 23 lands the shoe on the ground of hard surface acts collectively on the wall member 26 and the collectively acting pressure distorts the shoe bottom parts 21 as a whole and the layer 8. The resilient force generated in response to the action by the distortion acts as a springing force on the wall members 26 and exerts a so-called trampolin effect on the wall members 26. As the result, the sports shoe 23 is furnished with ample elasticity in the heel part. The wall members 26, therefore, are required to be so shaped that they will refrain from bending or deforming and will absorb the resilient force which the shoe bottom part 21 generates in response to the distortion caused by the pressure exerted thereon in the stamping direction. In the present embodiment, the wall members are arranged in the pattern of a lattice so as to intersect partially each other.

The width 27 and height 28 of the wall members 26 are decided by the number of portions 6 at which the wall members 26 intersect each other. The wall members 26 are such that the width 27 can be decreased and the height 28 increased in proportion as the number of the intersecting portions 6 increases. These dimensions can be determined suitably in accordance with the degree of the elasticity which the sports shoe 23 is expected to possess, namely the aforementioned resilient force which the walls 26 are enabled to generate.

In the embodiment illustrated in FIG. 3, the wall members 26 of the heel counter 22 are integrally thrust out of one surface 25 of the bottom surface part 7 to give rise to the recesses 4. They may be constructed conversely, as illustrated in FIG. 6, so as to thrust downwardly integrally from one surface 32 of the bottom surface part 7.

Figure 6:
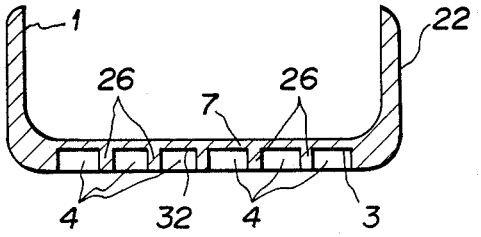
FIG. 6 is a cross section view taken through FIG. 2 along the line III—III, illustrating a typical heel counter of a sports shoe as the second embodiment of this invention.

On the other hand, the heel counter 22 may be so constructed as illustrated in FIG. 7 that a plurality of through holes 5 will be defined solely with the wall members 26 in the place of the plurality of recesses 4 which are defined jointly by the wall members 26 and the bottom surface part 7 as illustrated in FIG. 3 and FIG. 6.

The two-dimensional plan shapes and areas of the recesses 4 and the through holes 5 are suitably decided preferably in due consideration of the durability which the heel counter 22 is expected to possess.

For the sports shoe 23 to obtain the expected elasticity to a greater extent, it is desired to be provided with the heel counter 22 incorporating therein the plurality of through holes 5. Where more emphasis is placed on the durability, the sports shoe 23 is desired to be provided with the heel counter 22 incorporating therein the plurality of recesses 4. In other words, the wall members 26 which have the plurality of recesses 4 integrally formed on the bottom surface part 7 acquire ample strength enough to impart outstanding durability to the heel counter 22.

Figure 8:
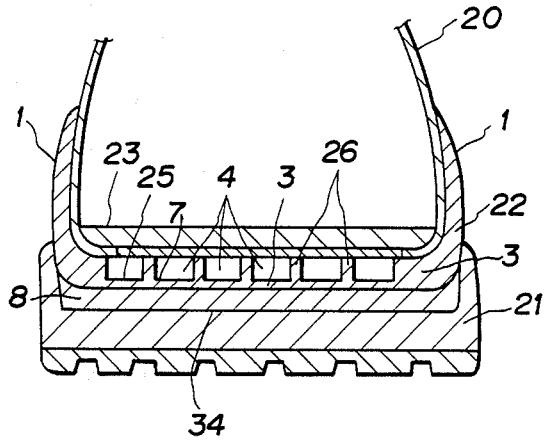
FIG. 8 is a cross section view illustrating the heel part of the sports shoe according to this invention provided with the heel counter of FIG. 3.
Figure 9:
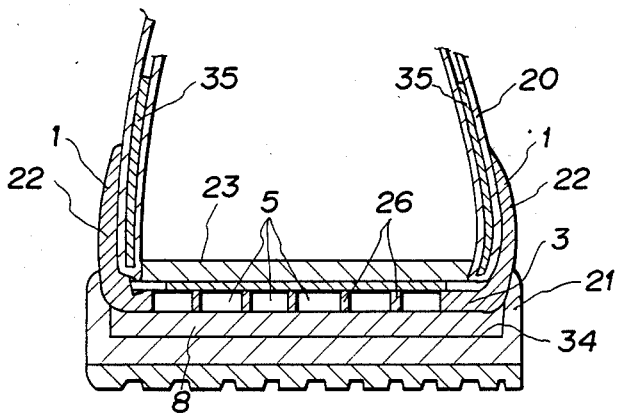
FIG. 9 is a cross section view illustrating the heel part of the sports shoe according to this invention provided with the heel counter of FIG. 7.

Now, the condition in which the heel counter 22 provided with the plurality of recesses 4 is attached to the sports shoe 23 is illustrated in FIG. 8 and the condition in which the heel counter 22 provided with the plurality of through holes 5 is attached to the sports shoe 23 in FIG. 9. As shown in FIG. 8 and FIG. 9, the sports shoe 23 has a surface part 34 of the shoe bottom part 21 opposed to the bottom surface part 7 on the lower surface part 3 of the heel counter 22. The sports shoe 22 is provided between the bottom surface part 7 and the surface part 34 with a multilayer construction incorporating therein the elastic member 8 possessing different hardness from the shoe bottom part 21. The elastic member 8 is preferably made of an elastic material abounding with softness and possessing hardness in the range of 30 to 35 degrees. The multilayer construction is desired to comprise layers having hardness gradually increased downwardly as illustrated in FIG. 8 and FIG. 9. Owing to the construction described above, the wall members 26 of the heel counter 22, on exposure to the pressure exerted thereon in the stamping direction when the user of the sports shoe 23 lands the shoe on the ground, easily sink down first against the shoe bottom part 21 and the elastic member 8 and, as the sinking proceeds, the distortion caused consequently in the wall members 26 and the shoe bottom part 21 and the elastic member 8 gives rise to resilient force. The sinking force and the resilient force synergistically act to impart highly desirable elasticity to the heel part of the sports shoe 23.

In the embodiment of FIG. 8, the heel counter 22 is directly nipped between the upper 20 and the shoe bottom part 21. On the other hand, the heel counter 22 may be nipped between the upper 20 and the shoe bottom part 21 through the medium of a heel cup 35 (crescent core) as illustrated in FIG. 9. In this case, the heel counter 22 is desirably fitted in the sports shoe 23 in such a manner as to cover the heel side wall parts 1, 1 from outside the upper 20. In the construction thus using the heel cup 35, the heel part of the sports shoe 23 is enabled to manifest the shape-retaining property and the stability to a greater extent.

Figure 10:
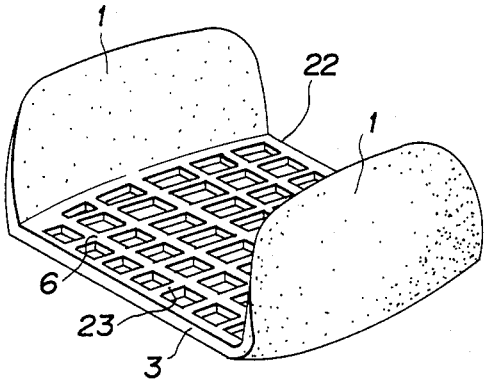
FIG. 10 is a perspective view of a typical heel counter of the sports shoe as the fourth embodiment of this invention.
Figure 11:
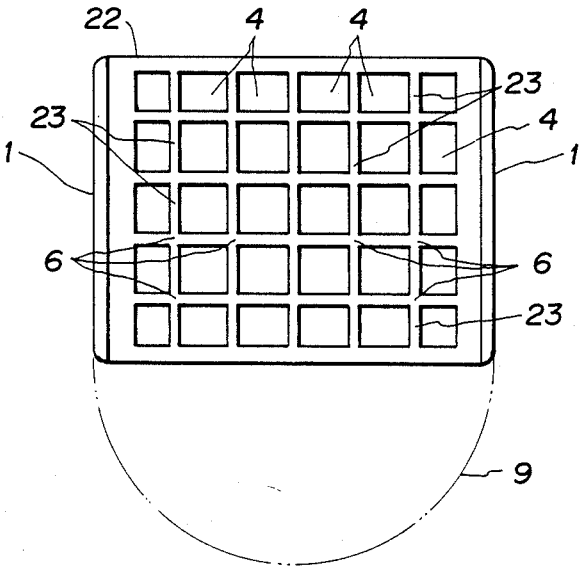
FIG. 11 is a plan view of the heel counter illustrated in FIG. 10.

FIG. 10 and FIG. 11 illustrate another typical heel counter 22 embodying the present invention. The heel counter 22 of this embodiment possesses basically the same function as the other heel counters of the embodiments described above. For the purpose of losing the weight of its own, this heel counter 22 omits a portion 9 corresponding to the curved portion of the under heel part 24 of the heel side wall part 1. For the heel counter 22 of this shape to possess ample strength enough to remain fast on the heel side wall part 1, namely to prevent the heel part of the sports shoe 23 from lateral sway, it is desired to be made of an elastic material possessing higher rigidity than that of the heel counter 22 illustrated in FIG. 2.

As described above, the sports shoe of the present invention is capable of preventing the heel part of shoe from lateral sway and absorbing the shock exerted upon the heel part because the heel side wall part and the lower surface part of the heel counter are integrally formed. Particularly, the wall members formed on the lower surface part of the heel counter are so adapted that the heel counter is enabled to generate the resilient force against the shoe bottom part in response to the exertion of increasing load per unit area during the landing of the shoe on the ground in the state of fitting the heel counter with the shoe. Thus, the sports shoe is furnished with highly desirable elasticity. Further, since the heel side wall parts and the lower surface part are integrally formed, the heel counter can be attached with an enhanced binding strength to the sports shoe and will not be easily separated from the upper or from the shoe bottom part on exposure to strong external pressure.

What is claimed is:

1. A sports shoe comprising an upper portion, a sole portion fitted to said upper portion, and a heel counter fixed to said upper portion and said sole portion, respectively, said heel counter including a lower part nipped between said upper portion and said sole portion, and having a plurality of wall members extending generally vertically and between upper and lower surfaces of said lower part to define a plurality of spaces, said spaces opening through at least one of said upper and lower surfaces toward said upper portion or said sole portion, respectively, each of said wall members having a wall thickness less than the lateral dimension of the spaces between said wall members and a heel side wall part formed integrally with said lower part, said heel side wall part extending along the periphery of said lower part and upwardly from said lower part.

2. A sports shoe according to claim 1, wherein said wall members extend both transversely and longitudinally of said shoe to define a lattice pattern in said lower part.

3. A sports shoe according to claim 1, wherein said spaces open through both said upper and lower surfaces of said lower part.

4. A sports shoe according to claim 1, wherein said upper portion has a heel portion positioned above said lower part, and said side wall part encloses substantially the entirety of said heel portion.

5. A sports shoe according to claim 1, wherein said upper portion has a heel portion positioned above said lower part, and said heel side wall part is formed only in the opposite lateral parts and encloses a part of said heel portion.

6. A sports shoe according to claim 1, wherein said wall members define spaces having different lateral dimensions relative to others of said spaces thereby providing spaces of unequal size in said lower part.

7. A sports shoe according to claim 1, wherein said wall members extend both transversely and longitudinally of said shoe to define a lattice pattern in said lower part, said spaces opening through both said upper and lower surfaces of said lower part.

8. A sports shoe according to claim 7, wherein said upper portion has a heel portion positioned above said lower part, and said side wall part encloses substantially the entirety of said heel portion.

9. A sports shoe according to claim 7, wherein said wall members define spaces having different lateral dimensions relative to others of said spaces thereby providing spaces of unequal size in said lower part.

* * * * *